US011257648B2

(12) United States Patent
Cho

(10) Patent No.: US 11,257,648 B2
(45) Date of Patent: Feb. 22, 2022

(54) ELECTRONIC TRIP DEVICE FOR MOLDED CASE CIRCUIT BREAKER

(71) Applicant: LS ELECTRIC CO., LTD., Anyang-si (KR)

(72) Inventor: Seongyeol Cho, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 0 days.

(21) Appl. No.: 16/954,858

(22) PCT Filed: Dec. 11, 2018

(86) PCT No.: PCT/KR2018/015692
§ 371 (c)(1),
(2) Date: Jun. 17, 2020

(87) PCT Pub. No.: WO2019/156328
PCT Pub. Date: Aug. 15, 2019

(65) Prior Publication Data

US 2021/0090837 A1 Mar. 25, 2021

(30) Foreign Application Priority Data

Feb. 6, 2018 (KR) ..... 10-2018-0014807

(51) Int. Cl.
*H01H 71/02* (2006.01)
*H01H 71/10* (2006.01)

(52) U.S. Cl.
CPC ..... *H01H 71/10* (2013.01); *H01H 71/02* (2013.01)

(58) Field of Classification Search
CPC ..... H01H 71/10; H01H 71/02; H01H 71/123; H01H 71/2472; H01H 71/7409; H01H 2009/546; H01H 73/02
(Continued)

(56) References Cited

U.S. PATENT DOCUMENTS 4,858,056 A * 8/1989 Russell ..... H01H 83/20 361/98
5,379,013 A * 1/1995 Coudert ..... H01H 71/06 335/17

(Continued)

FOREIGN PATENT DOCUMENTS

CN 101483121 A 7/2009
EP 2079091 A1 7/2009

(Continued)

OTHER PUBLICATIONS

International Search Report for related International Application No. PCT/KR2018/015692; report dated Aug. 15, 2019; (5 pages).

(Continued)

*Primary Examiner* — William A Bolton
(74) *Attorney, Agent, or Firm* — K&L Gates LLP

(57) ABSTRACT

The present invention relates to a trip device for a molded case circuit breaker and, more specifically, to an electronic trip device for a molded case circuit breaker. The electronic trip device for a molded case circuit breaker, according to one embodiment of the present invention, comprises: a trip part case having a plurality of phases; a trip part terminal provided at the rear surface part of the trip part case and provided for each phase; and a voltage sensing conductor coupled between the rear surface part and the trip part terminal and provided for each phase, wherein the voltage sensing conductor provided for each phase is formed to have the same shape and the same size.

12 Claims, 6 Drawing Sheets

(58) Field of Classification Search
USPC ..... 200/293; 335/172, 201, 202
See application file for complete search history.

(56) References Cited

U.S. PATENT DOCUMENTS

| | | | | |
|---|---|---|---|---|
| 6,100,777 | A * | 8/2000 | Mueller | H01H 71/002 335/172 |
| 6,853,279 | B1 | 2/2005 | Puskar et al. | |
| 6,909,586 | B2 | 6/2005 | Culler et al. | |
| 8,169,283 | B2 * | 5/2012 | Siebels | H01H 71/0228 335/202 |
| 8,358,188 | B2 * | 1/2013 | Bellotto | H01H 71/7409 335/202 |
| 8,558,650 | B2 * | 10/2013 | Paek | H01H 71/525 335/172 |
| 9,202,655 | B2 * | 12/2015 | Bertrand | H01H 11/0062 |
| 2003/0179526 | A1 * | 9/2003 | Culler | H01H 71/125 361/90 |
| 2005/0024173 | A1 | 2/2005 | Puskar et al. | |
| 2011/0094863 | A1 * | 4/2011 | Fleege | H01H 71/06 200/293 |

FOREIGN PATENT DOCUMENTS

| | | | |
|---|---|---|---|
| JP | H10302603 | A | 11/1998 |
| JP | 2009170422 | A | 7/2009 |
| JP | 2018010864 | A | 1/2018 |
| KR | 100835371 | B1 | 6/2008 |
| KR | 20090077725 | A | 7/2009 |
| KR | 101168257 | B1 | 7/2012 |
| KR | 20120077142 | A | 7/2012 |
| WO | 2013064630 | A1 | 5/2013 |

OTHER PUBLICATIONS

Written Opinion for related International Application No. PCT/KR2018/015692; report dated Aug. 15, 2019; (3 pages).
Chinese Office Action for related Chinese Application No. 201880083883.3; action dated Dec. 2, 2021; (6 pages).
Japanese Notice of Allowance for related Japanese Application No. 2020-542383; action dated Oct. 26, 2021; (3 pages).
Extended European Search report for related European Application No. 18904989.3; action dated Oct. 6, 2021; (6 pages).
Japanese Office Action for related Japanese Application No. 2020-542383; action dated Sep. 17, 2021; (3 pages).

* cited by examiner

ELECTRONIC TRIP DEVICE FOR MOLDED CASE CIRCUIT BREAKER

CROSS-REFERENCE TO RELATED APPLICATIONS

This application is the National Stage filing under 35 U.S.C. 371 of International Application No. PCT/KR2018/015692, filed on Dec. 11, 2018, which claims the benefit of earlier filing date and right of priority to Korean Application No. 10-2018-0014807, filed on Feb. 6, 2018, the contents of which are all hereby incorporated by reference herein in their entirety.

FIELD OF THE INVENTION

The present disclosure relates to a trip device for a molded case circuit breaker, and one particular implementation relates to an electronic trip device for a molded case circuit breaker.

BACKGROUND OF THE INVENTION

Generally, a molded case circuit breaker (MCCB) is an electric apparatus that protects circuits and loads by automatically breaking such circuits in the event of an electrical overload or short-circuit.

A molded case circuit breaker includes a terminal part disposed in an enclosure formed of a mold to be connected to a power source side or a load side, a contact part provided with a fixed contact and a movable contact contactable with or separated from the fixed contact to connect or disconnect a circuit, a switching mechanism configured to move the movable contact to provide power required for opening or closing a circuit, a trip part configured to induce a trip operation of the switching mechanism by detecting an overcurrent or short-circuit current at the load side, an arc-extinguishing part configured to extinguish an arc generated when a fault current is cut off, and the like.

Here, the trip part of the molded case circuit breaker performs a main function of breaking a mechanism part by detecting a fault current and a short-circuit current, so as to protect the load and the line. Trip parts are classified into a thermal type and an electronic type according to a trip method. The thermal type is configured to break the mechanism part by way of deformation of a conductor caused due to a current flowing on the conductor and resistance of the conductor. On the other hand, the electronic type is configured to operate the mechanism part by employing a device capable of detecting a current flowing on a conductor. The electronic type is configured to operate the mechanism part in a control panel by measuring the current flowing on the conductor. The electronic trip device performs an auxiliary function of measuring a voltage, in addition to the main function of measuring the current.

Hereinafter, an electronic trip device for a molded case circuit breaker according to the related art will be described. An example of an electronic trip device for a molded case circuit breaker according to the related art is disclosed in Korean Patent Registration No. 10-1489973 that is titled [Electronic trip device case for circuit breaker, electronic trip device and assembly method thereof] (U.S. Pat. No. 8,358,188 as a family patent).

The related art molded case circuit breaker includes a main body, a trip part, a voltage sensing part case, a voltage sensing part, a control panel, a conductor, and the like.

The voltage sensing part is assembled to the case and connected to a conductor of a current sensing device and the control panel. The voltage sensing part performs a function of sensing a voltage flowing on the conductor and delivering the sensed voltage to the control panel.

The voltage sensing part case of the related art is configured by two components. Also, the voltage sensing part that is provided for each phase in the voltage sensing part case has a different shape.

As a result, the configuration of those components is complicated, and productivity and assembly performance are lowered. That is, components which are provided for respective phases to detect voltages are different in shape, which makes a voltage sensing structure complicated. In addition, since a case for mounting the voltage sensing parts is provided separately, the number of components is increased and an additional installation space is required.

BRIEF SUMMARY OF THE INVENTION

The present disclosure has been invented to solve the aforementioned problems, and one aspect of an implementation is to provide an electronic trip device for a molded case circuit breaker having a single voltage sensing component applied to all phases of the electronic trip device.

Another aspect of an implementation is to provide an electronic trip device for a molded case circuit breaker having a compact trip part.

An electronic trip device for a molded case circuit breaker according to one embodiment of the present invention may include a trip part case having a plurality of phases, a trip part terminal provided at the rear surface part of the trip part case and provided for each phase, and a voltage sensing conductor coupled between the rear surface part and the trip part terminal and provided for each phase. The voltage sensing conductor provided for each phase may be formed to have the same shape and the same size.

The trip part case may be provided with an accommodating portion for each phase, and a partition wall may be formed between the accommodating portions.

The accommodating portion may be provided with a connection conductor installation portion in which a connection conductor for connecting the trip part terminal and a load side terminal is inserted.

The trip part case may be provided with an upper accommodating portion formed in a top thereof for accommodating a control panel.

The upper accommodating portion may be provided with a through hole for each phase, through which a contact portion formed on an end portion of the voltage sensing conductor is inserted. The through hole provided for each phase may be formed in the same shape and the same size.

The trip part case may be provided with an accommodating groove for each phase, formed on the rear surface part thereof to accommodate the voltage sensing conductor. The accommodating groove provided for each phase may be formed in the same shape and the same size.

The accommodating groove may be provided with a coupling groove in which the trip part terminal and the voltage sensing conductor are coupled to each other.

The trip part case may be provided with an arrangement groove formed in the rear surface part for arranging wires, and the arrangement groove may be provided to correspond to a height of the connection conductor installation portion.

The voltage sensing conductor may be provided with a coupling hole formed at a position corresponding to the coupling groove.

The voltage sensing conductor may be provided with a bent portion inserted into the arrangement groove.

The voltage sensing conductor may be provided with a cutout portion for avoiding interference with the connection conductor.

The contact portion inserted through the through hole may be formed on an upper portion of one side of the voltage sensing conductor.

The control panel may be provided with a coupling groove at a position corresponding to the through hole.

The control panel may be coupled with a cover member covering the coupling hole.

According to an electronic trip device of a molded case circuit breaker according to one implementation of the present disclosure, a voltage sensing component provided for each phase of the electronic trip device can be unified, which may result in enabling the component to be commonly used. Accordingly, a manufacturing cost can be reduced and assembling performance and productivity can be improved.

In addition, a trip part case is unified and an occupied space is reduced. Accordingly, the molded case circuit breaker can be manufactured in a compact size.

DETAILED DESCRIPTION OF THE INVENTION

Hereinafter, preferred embodiments of the present invention will be described with reference to the accompanying drawings, so that a person skilled in the art can easily carry out the invention. It should be understood that the technical idea and scope of the present invention are not limited to those preferred embodiments.

Figure 1:
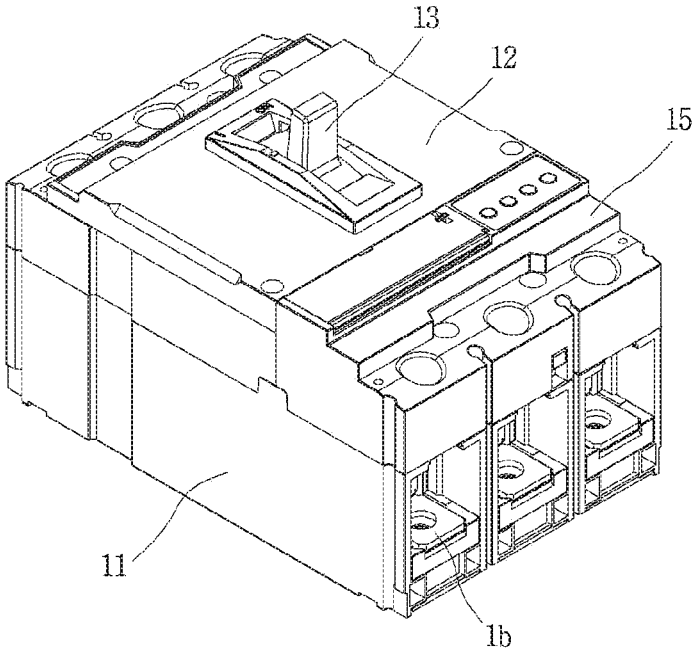
FIG. 1 is a perspective view of a molded case circuit breaker in accordance with one implementation of the present disclosure.
Figure 2:
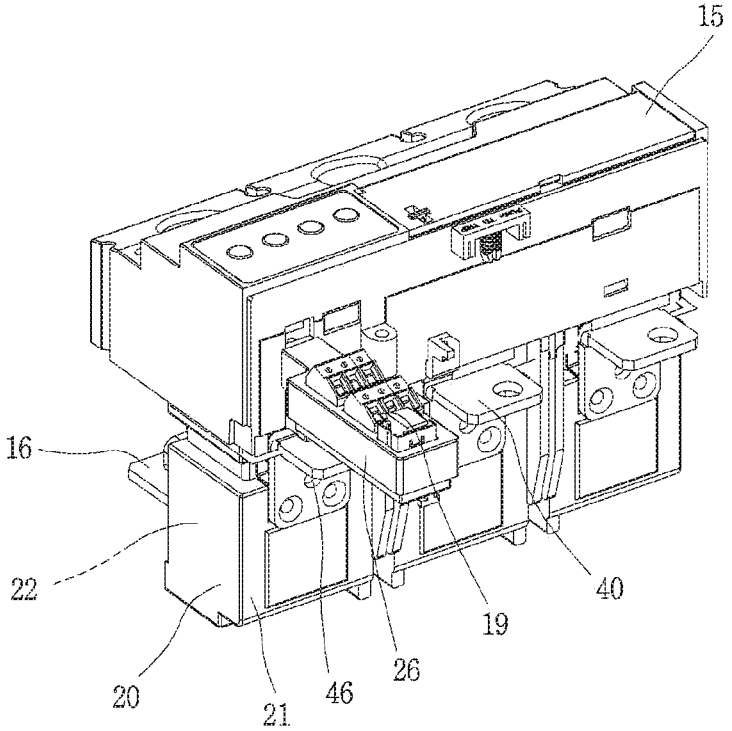
FIG. 2 is a rear perspective view of the electronic trip device illustrated in FIG. 1.
Figure 3:
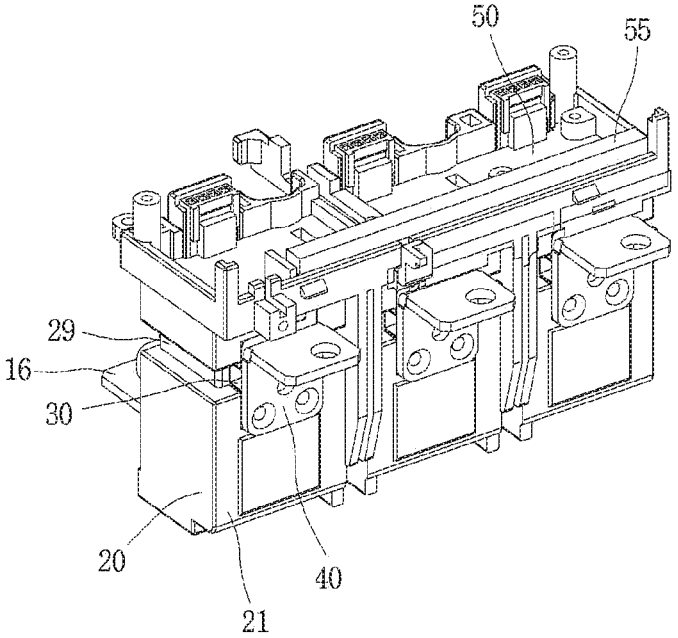
FIGS. 3 and 4 are a rear perspective view and a rear exploded perspective view illustrating a state in which a cover is removed in FIG. 2.
Figure 4:
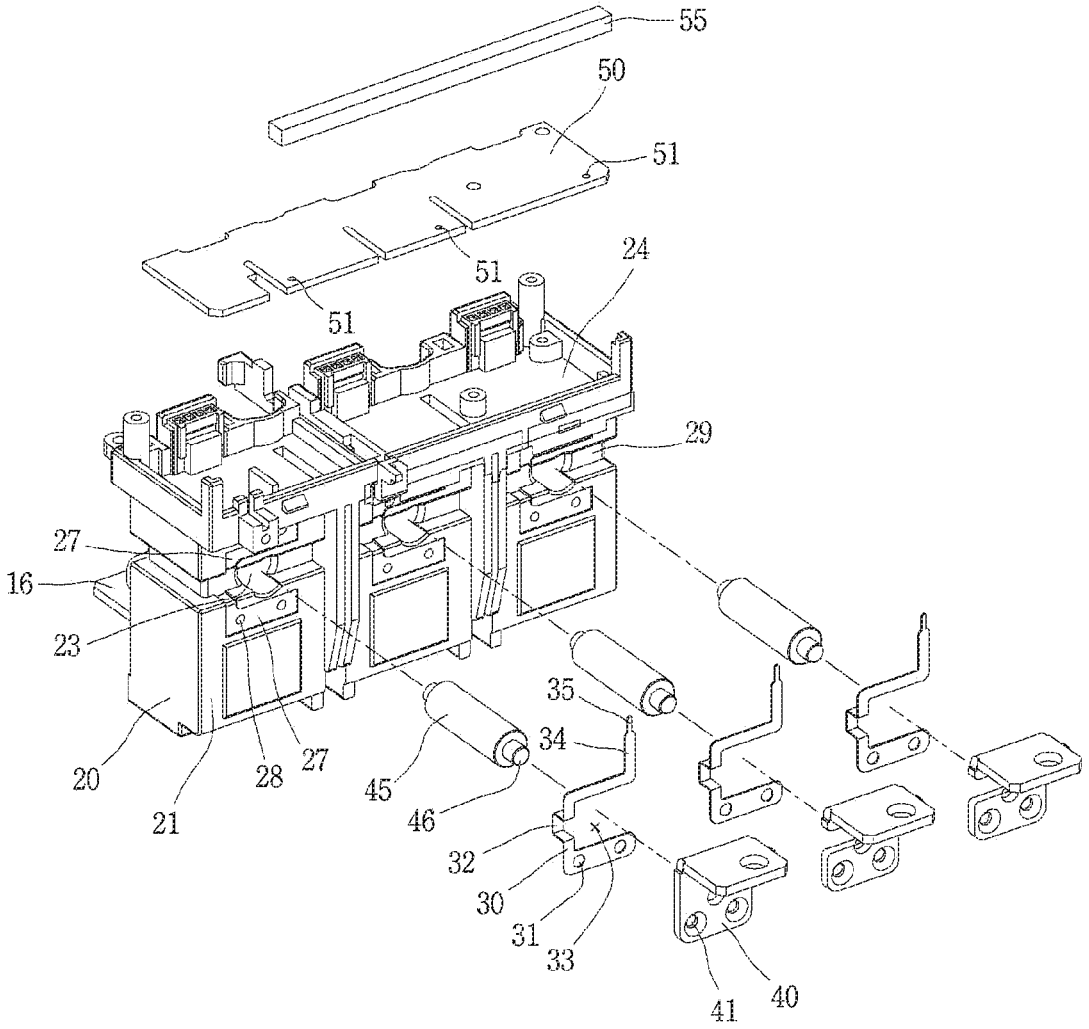
Figure 5:
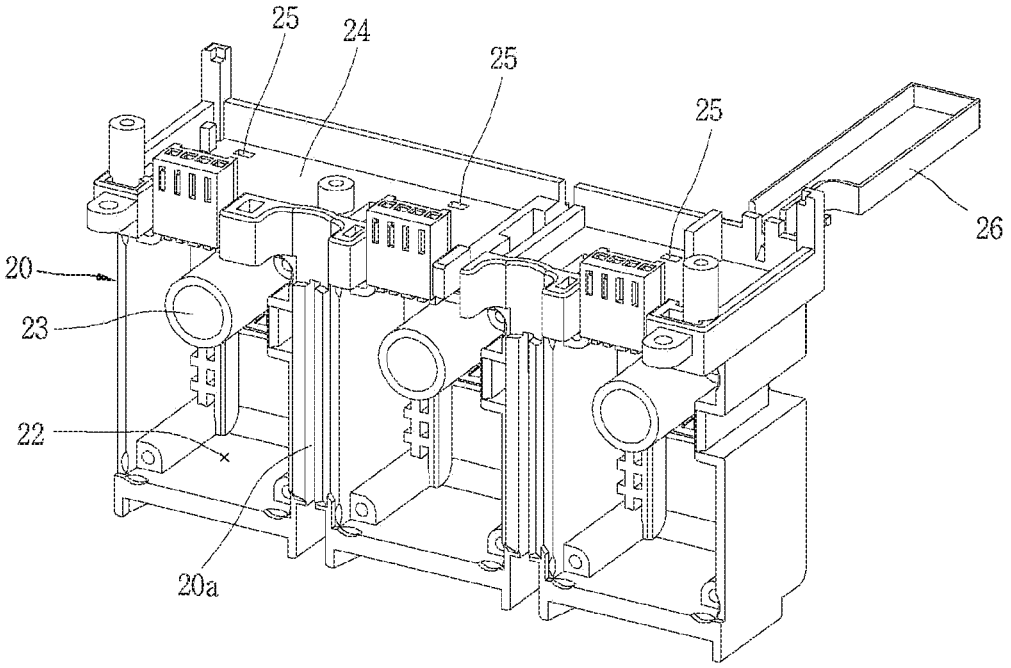
FIG. 5 is a front perspective view of a trip part case in FIG. 3.

FIG. 1 is a perspective view of a molded case circuit breaker in accordance with one implementation of the present disclosure, FIG. 2 is a rear perspective view of the electronic trip device illustrated in FIG. 1, FIGS. 3 and 4 are a rear perspective view and a rear exploded perspective view illustrating a state in which a cover is removed in FIG. 2, and FIG. 5 is a front perspective view of a trip part case in FIG. 3. Hereinafter, an electronic trip device for a molded case circuit breaker in accordance with an implementation of the present disclosure will be described in detail with reference to the accompanying drawings.

An electronic trip device for a molded case circuit breaker according to one implementation of the present disclosure includes a trip part case 20 having a plurality of phases, a trip part terminal 40 provided at a rear surface part 21 of the trip part case 20 and provided for each phase, and a voltage sensing conductor 30 coupled between the rear surface part 21 and the trip part terminal 40 and provided for each phase. The voltage sensing conductor 30 provided for each phase has the same shape and the same size.

FIG. 1 illustrates a molded case circuit breaker in accordance with one implementation of the present disclosure. An enclosure of the molded case circuit breaker may be defined by a case 11 and a cover 12. A handle 13 of a switching mechanism is exposed at a central portion of the cover 12 to allow user manipulation.

A trip part cover 15 is disposed at one side of the cover 12. The trip part cover 15 may be provided at a load side.

FIG. 2 illustrates the electronic trip device for the molded case circuit breaker in accordance with the one implementation of the present disclosure. The electronic trip device includes a trip part case 20, a trip part cover 15, a current sensing part, and a voltage sensing part.

FIG. 5 is a rear perspective view of the trip part case 20 applied to the electronic trip device for the molded case circuit breaker according to the one implementation of the present disclosure.

The trip part case 20 is configured to accommodate a plurality of phases or poles. For example, in the case of three phases (e.g., R-phase, S-phase, and T-phase), the trip part case 20 may be divided into three sections (spaces). On the other hand, in the case of three phases and four poles (R-pole, S-pole, T-pole, and N-pole), the trip part case 20 is divided into four sections (spaces). At this time, a partition wall 20*a* may be provided between adjacent phases. The partition wall 21 may be provided as a double wall to secure a creepage distance and improve insulation performance. Accordingly, an accommodating portion 22 is provided for each phase. The accommodating portion 22 has a front surface open. The current sensing part (not shown) is installed in each accommodating portion 22.

The accommodating portion 22 is provided with a connection conductor installation portion 23 in which a connection conductor 45 can be inserted. The connection conductor installation portion 23 may be configured as a tube or a hole.

A control unit is provided on a top of the trip part case 20. The control unit includes a control panel 50. An upper accommodating portion 24 in which the control panel 50 is accommodated is provided in the top of the trip part case 20. The upper accommodating portion 24 may be formed in a box shape with an upper surface open. The upper accommodating portion 24 may protrude to the front and rear of the trip part case 20.

The upper accommodating portion 24 is provided with a through hole 25 through which an end portion of the voltage sensing conductor 30 can be inserted. The through hole 25 is provided for each phase. The through hole 25 provided for each phase is formed in the same shape and the same size.

A user interface accommodating portion 26 in which a user interface can be installed is provided in a part of the rear of the trip part case 20.

The description will be given additionally with reference to FIG. 4. The rear surface part 21 of the trip part case 20 is provided with an accommodation groove 27 in which the voltage sensing conductor 30 can be mounted. A part of the accommodation groove 27 communicates with the through hole 25. The accommodation groove 27 is provided for each phase. The accommodation groove 27 provided for each phase is formed in the same shape and the same size.

The accommodation groove 27 is provided with a coupling groove 28 in which the trip part terminal 40 and the voltage sensing conductor 30 are coupled to each other.

An arrangement groove 29 for arranging wires is formed along the rear surface part 21 and side surfaces of the trip part case 20. The arrangement groove 29 may be provided at a height of the connection conductor installation portion 23.

The connection conductor 45 is inserted into the connection conductor installation portion 23. A front end portion of the connection conductor 45 is exposed to the load side, and a rear end portion of the connection conductor 45 is exposed to a power source side. The front end portion of the connection conductor 45 is connected to a load-side terminal 16, and the rear end portion of the connection conductor 45 is connected to the trip part terminal 40. The connection conductor 45 serves as a path of current flowing from the power source side to the load side, and simultaneously is a component of the current sensing part for measuring a current.

The trip part terminal 40 may be formed in a shape like '¬'. The trip part terminal 40 is installed on the rear surface part 21 of the trip part case 20. The trip part terminal 40 is coupled to the coupling groove 28 of the rear surface part 21 by a coupling member (not shown, for example, a screw).

The voltage sensing conductor 30 is made of a conductor. The voltage sensing conductor 30 is provided with a coupling hole 31 to be coupled to the coupling groove 28 by the coupling member (not shown). The coupling hole 31 may be provided in pair. The coupling hole 31 is formed at a position corresponding to the coupling groove 28.

The voltage sensing conductor 30 is provided with a bent portion 32 inserted into the arrangement groove 29. The bent portion 32 may be bent to correspond to the shape of the arrangement groove 29. The bent portion 32 may be formed in a shape like '⊏'.

Figure 6:
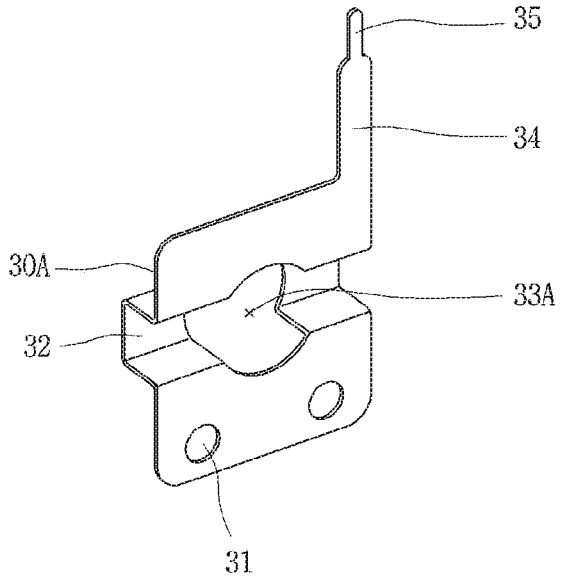
FIG. 6 is a perspective view of a voltage sensing conductor in accordance with another implementation of the present disclosure.

The voltage sensing conductor 30 is provided with a cutout portion 33 to avoid interference with the connection conductor 45. The cutout portion 33 may be formed in a shape of a groove or hole. The cutout portion 33 of the implementation shown in FIG. 4 is formed as a groove. FIG. 6 illustrates an example of a voltage sensing conductor 30A having a cutout portion 33A formed as a hole.

An extension portion 34 and a contact portion 35 are provided on an upper portion of one side of the voltage sensing conductor 30. The extension portion 34 and the contact portion 35 are formed flat. The contact portion 35 may have a narrower width than the extension portion 34.

The contact portion 35 is inserted through the through hole 25 so that an end portion thereof is exposed to the upper accommodating portion 24. The contact portion 35 is welded to the control panel 50. Accordingly, it is possible to detect (measure) a voltage of the trip part terminal 40 in the control panel 50.

The voltage sensing conductor 30 is formed on the same plane, except for the bent portion 32. The voltage sensing conductor 30 for each phase has the same shape and size. The voltage sensing conductor 30 for each phase is formed to have a length ranging from the trip part terminal 40 to the through hole 25. This may result in reducing the size of the component. Therefore, assembly performance can be improved and components can be used in combination, thereby achieving excellent productivity.

The voltage sensing conductor 30 is inserted into the accommodating groove 27 of the rear surface part 21. Therefore, the voltage sensing conductor 30 does not protrude to the outside of the rear surface part 21. It can contribute to a compact configuration and facilitate assembling.

The voltage sensing conductor 30 is provided between the rear surface part 21 of the trip part case 20 and the trip part terminal 40 so as not to be exposed to the outside. Therefore, the voltage sensing conductor 30 can be easily manufactured and there is no need for a separate voltage sensing conductor case, which contributes to improving insulation performance.

The user interface 19 is provided in the user interface accommodating portion 26 (see FIG. 2).

The control panel 50 is inserted into the upper accommodating portion 24 (see FIGS. 3 to 5). The control panel 50 is provided with a coupling hole 51 in which the contact portion 35 of the voltage sensing conductor 30 is inserted. The contact portion 35 inserted into the coupling hole 51 may be welded to the control panel 50. Here, the coupling hole 51 is formed at a position corresponding to the through hole 25 of the upper accommodating portion 24.

A cover member 55 is provided. The cover member 55 is coupled to cover a portion of the control panel 50 where the coupling holes 51 are located.

According to the electronic trip device of the molded case circuit breaker according to the one implementation of the present disclosure, a voltage sensing component (the voltage sensing conductor 30) provided for each phase of the electronic trip device is unified, which enables the component to be commonly used. Accordingly, a manufacturing cost can be reduced and assembling performance and productivity can be improved.

In addition, the trip part case 20 is unified and an occupied space is reduced. That is, a separate case for accommodating the voltage sensing conductor 30 is not necessary. Accordingly, the molded case circuit breaker can be manufactured in a compact size.

The voltage sensing conductor 30 is inserted into the accommodating groove 27 of the rear surface part 21. Therefore, the voltage sensing conductor 30 does not protrude to the outside of the rear surface part 21. It can contribute to a compact configuration and facilitate assembling. The voltage sensing conductor 30 is provided between the rear surface part 21 of the trip part case 20 and the trip part terminal 40 so as not to be exposed to the outside. Therefore, the voltage sensing conductor 30 can be easily manufactured and there is no need for a separate voltage sensing conductor case, which contributes to improving insulation performance.

While the disclosure has been shown and described with reference to the foregoing preferred embodiments thereof, it will be understood by those skilled in the art that various changes and modifications may be made without departing from the spirit and scope of the invention as defined by the appended claims. Therefore, the embodiments disclosed in the present disclosure are not intended to limit the scope of the present disclosure but are merely illustrative, and it should be understood that the scope of the technical idea of the present disclosure is not limited by those embodiments. That is, the scope of protection of the present invention should be construed according to the appended claims, and all technical ideas within the scope of equivalents thereof should be construed as being included in the scope of the present invention.

The invention claimed is:

1. An electronic trip device for a molded case circuit breaker, the electronic trip device comprising:

a trip part case having a plurality of phases;

a trip part terminal provided at a rear surface part of the trip part case and provided for each phase; and a voltage sensing conductor coupled between the rear surface part and the trip part terminal and provided for each phase, wherein the voltage sensing conductor provided for each phase is formed to have a same shape and a same size, wherein the trip part case is provided with an accommodating groove for each phase, formed in the rear surface part thereof to accommodate the voltage sensing conductor, wherein the accommodating groove is provided with a coupling groove in which the trip part terminal and the voltage sensing conductor are coupled to each other, and wherein the voltage sensing conductor is provided with a coupling hole formed at a position corresponding to the coupling groove.

2. The electronic trip device of claim 1, wherein the trip part case is provided with an accommodating portion for each phase, and wherein a partition wall is formed between accommodating portions.

3. The electronic trip device of claim 2, wherein the accommodating portion is provided with a connection conductor installation portion in which a connection conductor for connecting the trip part terminal and a load side terminal is inserted.

4. The electronic trip device of claim 3, wherein the trip part case is provided with an arrangement groove formed in the rear surface part thereof for arranging wires, and wherein the arrangement groove is provided to correspond to a height of the connection conductor installation portion.

5. The electronic trip device of claim 4, wherein the voltage sensing conductor is provided with a bent portion inserted into the arrangement groove.

6. The electronic trip device of claim 3, wherein the voltage sensing conductor is provided with a cutout portion for avoiding interference with the connection conductor.

7. The electronic trip device of claim 1, wherein the trip part case is provided with an upper accommodating portion formed in a top thereof for accommodating a control panel.

8. The electronic trip device of claim 7, wherein the upper accommodating portion is provided with a through hole for each phase, through which a contact portion formed on an end portion of the voltage sensing conductor is inserted, and wherein the through hole provided for each phase is formed in a same shape and a same size.

9. The electronic trip device of claim 8, wherein the contact portion inserted through the through hole is formed on an upper portion of one side of the voltage sensing conductor.

10. The electronic trip device of claim 8, wherein the control panel is provided with a coupling groove at a position corresponding to the through hole.

11. The electronic trip device of claim 10, wherein the control panel is coupled with a cover member covering the coupling hole.

12. The electronic trip device of claim 1, wherein the accommodating groove provided for each phase is formed in a same shape and a same size.

* * * * *